United States Patent [19]

Nyun

[11] Patent Number: 4,747,282

[45] Date of Patent: May 31, 1988

[54] GUARD DEVICE FOR AUTOMOBILE IGNITION LOCK

[76] Inventor: Albert S. Nyun, 16323 Glen Hope Dr., Valenda, Calif. 91744

[21] Appl. No.: 33,531

[22] Filed: Apr. 3, 1987

[51] Int. Cl.[4] ..... E05B 17/14

[52] U.S. Cl. ..... 70/426; 70/424; 70/398; 70/399

[58] Field of Search ..... 70/398, 399, 423, 424, 70/426, 429, 430

[56] References Cited

U.S. PATENT DOCUMENTS

| | | | |
|---|---|---|---|
| 119,851 | 10/1871 | Jenny | 70/426 |
| 442,778 | 12/1890 | Metzger | 70/426 |
| 942,537 | 12/1909 | Batdort | 70/426 |
| 947,913 | 2/1910 | Jenkins | 70/399 |
| 1,000,962 | 8/1911 | Blais | 70/426 |

FOREIGN PATENT DOCUMENTS

| | | | |
|---|---|---|---|
| 627736 | 3/1936 | Fed. Rep. of Germany | 70/424 |
| 827053 | 1/1938 | France | 70/424 |

*Primary Examiner*—Robert L. Wolfe
*Attorney, Agent, or Firm*—Erik M. Arnhem

[57] ABSTRACT

The keyway of an automobile ignition lock can be protected by a key-shaped element which is secured by a combination lock to substantially preclude tampering with the automobile ignition lock. The guard device can be removed from the ignition lock keyway upon setting of the combination lock dials to the release position, and the regular ignition key can then be used with the ignition lock.

8 Claims, 2 Drawing Sheets

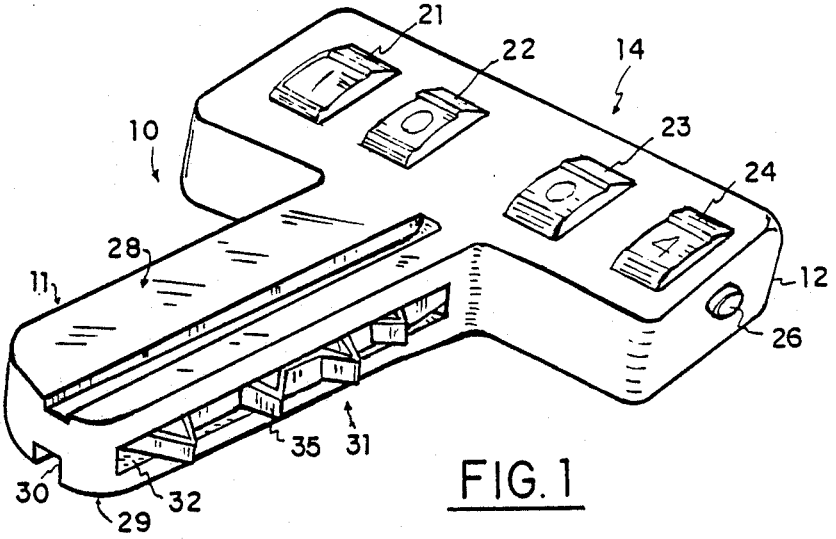
FIG. 1
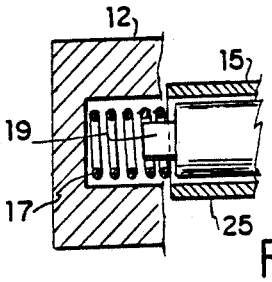
FIG. 3
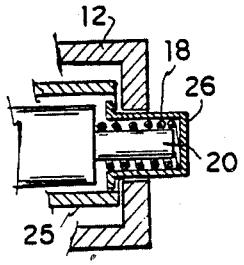
FIG. 4
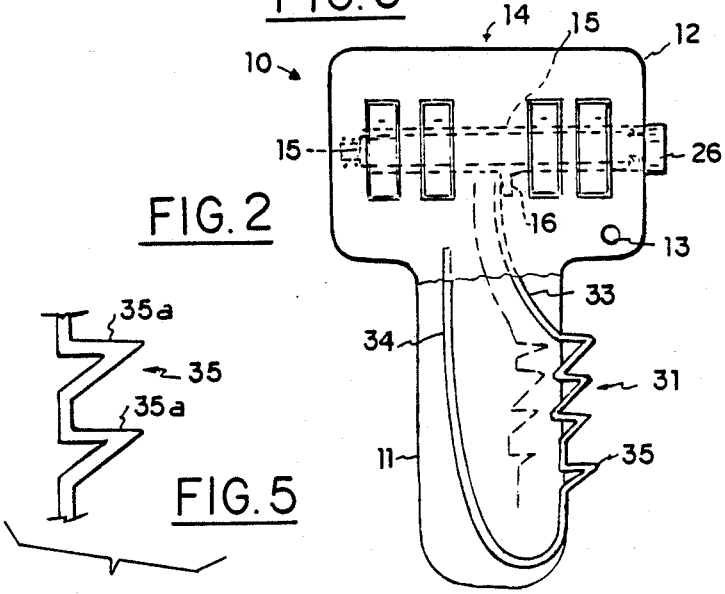
FIG. 2
FIG. 5

GUARD DEVICE FOR AUTOMOBILE IGNITION LOCK

BACKGROUND OF THE INVENTION (1) Field of the Invention

My invention is concerned with an improvement relating to an automobile ignition lock anti-tampering or similar lock protection or guard device.

More particularly, my invention relates to a guard device for the keyhole or keyway of the ignition lock at the steering wheel column in cars, trucks and the like vehicles to preclude unauthorized use of the lock by blocking the ignition keyway.

(2) Prior Art

Various combination operated keyhole blocking devices have been made known in the prior art and including U.S. Pat. Nos. 3,732,711; 3,723,682; 1,000,962; 942,537; 442,778; 145,865; and 119,851.

Combination locks are keyless devices in which a number of dials or rings, inscribed with numbers or letters on the circumferential side or edge, are arranged in parallel on a central lock spindle. Selective rotation or turning of the dials until the correct combination has been established, will allow that the lock spindle can be brought into the position which allows opening of the lock, because the respective slots and other cooperating elements inside the rings with four rings or tumblers and 10 numbers presents 10,000 possible combinations.

However, there has remained a need for a combination operated keyhole blocking devices for automobile ignition locks to provide an economic and effective anti-theft or guard device which substantially precludes tampering with the respective ignition lock in which it is used.

SUMMARY OF THE INVENTION

In accordance with my invention there is provided a keyhole or keyway guard device for autombile ignition locks which comprises: a hollow handle portion or end; a combination lock means with the lock mechanism thereof including at least one main bolt, and with the mechanism being housed in the hollow handle portion or end; a hollow blade end unitary with the hollow handle portion and its interior in communication with the interior of said hollow handle portion; and a spring element operatively connectable to the main bolt of the combination lock mechanism.

The spring element and the combination lock selectively interact in such a way such that the hollow blade end can be inserted into the respective automobile ignition lock, but it can then only selectively be taken out of the keyway of the respective automobile ignition lock by setting of the unlocking combination, thereby to allow actuation of the main bolt of the lock mechanism and to allow retraction of the spring element.

In accordance with one aspect of my invention, the guard device has a combination lock means which includes four dials with 10 numbers.

Thus, the invention contemplates a keyhole blocking or guard device which can be inserted with its blade end into the keyhole or keyway of an automobile ignition lock, and the spring element can assume the blocking or advanced position thereby to substantially preclude unauthorized use of the ignition of the respective vehicle. The device generally corresponds in shape to a key, but is formed with a hollow blade end. The spring element has a plurality of spring biased teeth formations, and it is movably disposed in the hollow blade. The spring element can be moved between the first, active or blocking, position and a second, inactive or retracted, position in conformity with the main bolt which, in turn, is housed in the hollow handle portion of the device and which main bolt is secured by a combination lock. When the combination lock has been set to open, the main bolt can be actuated to bring the spring biased teeth formation into the second, inactive or retracted, position, whereupon the guard or blocking device can be removed from the keyway.

Included in the objects of my invention are:

To provide an automobile ignition keyway blocking element or guard device which can be locked to preclude unauthorized use of the vehicle in which it is employed.

To provide a simple yet effective anti-theft device for cars.

To provide an combination lock guard device for automobile ignition keyway which device is economical in structure and manufacture.

DESCRIPTION OF THE DRAWING

The foregoing and other objects, features and advantages will become apparent from the following description, reference being made to the accompanying drawing in which:

FIG. 1 is a perspective view of the guard device.

FIG. 2 is a top plan view of the guard device with the body shown in phantom outline.

FIG. 3 is a cross-sectional view showing the one journal end of the main bolt;

FIG. 4 is a similar cross-sectional view showing the actuation end of the main bolt;

FIG. 5 is a detail showing the outline of a tooth formation;

SPECIFIC DESCRIPTION

Figure 6:
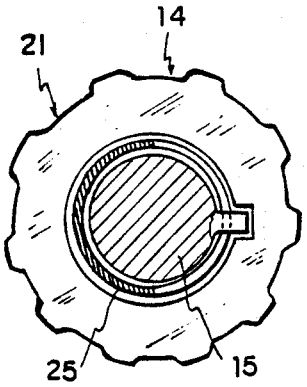
FIG. 6 shows cross section through a dial ring and the main bolt.

The keyhole blocking or guard device for automobile ignition locks is generally identified by reference numeral 10. It performs the function of an anit-theft device for the respective automobile ignition by being capable of blocking the keyway of the ignition lock, and its shape is generally analogous to that of a standard ignition key.

The guard device 10 comprises a forwardly disposed hollow blade end or formation 11 and a rearward handle portion 12 which can have a key chain hole 13. The handle portion 12 is also hollow and houses the combination lock means, generally identified by reference numeral 14, of the guard device 10.

The hollow blade end 11 can be readily inserted into the keyway of the respective automobile ignition lock (not shown), but it can only selectively be taken out of the keyway of the respective automobile ignition lock, with knowledge and setting of that combination which will allow actuation of the main bolt 15. The main bolt 15 is generally a round shaft or similar roller with an actuation pin 16 at its approximate center. The springs 17 and 18 respectively bias the ends 19 and 20 of the main bolt 15.

In the described embodiment, the combination lock mechanism or device 14 has four rings or dials 21, 22, 23, and 24, each having 10 digits arranged sequentially from "1" to "0" on the circumferential edge or face thereof, with the combination lock mechanism 14, accordingly, affording 10,000 possible lock combinations.

Figure 7:
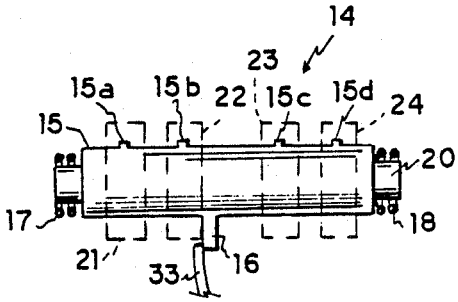
FIG. 7 is a diagrammatic view showing the main bolt in the activated position to allow removing the guard device.
Figure 8:
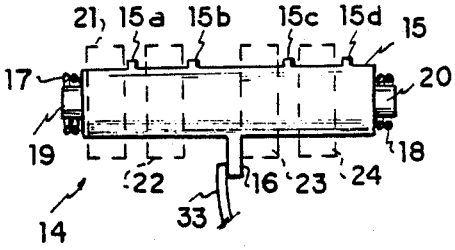
FIG. 8 is a diagrammatic view according to FIG. 7 but showing the main bolt in the normal position.

The main bolt 15 is provided with projections or lock formations 15*a*, 15*b*, 15*c* and 15*d*, see particularly FIGS. 7 and 8. These lock formations 15*a*, 15*b*, 15*c* and 15*d*, as well as the actuation pin 16 can extend through a retaining sleeve 25 which surrounds part of the main bolt 15, but which is otherwise formed with apertures or slots to allow functioning of the lock formations 15*a*, 15*b*, 15*c* and 15*d* and of the actuation pin 16.

With particular reference to FIG. 6, the selected dial may be set at "1", the respective groove is then aligned with the respective lock formation to allow axial movement of the main bolt 15. Of course, when all dials 21, 22, 23 and 24 are set in the correct combination, the main bolt 15 can be freely moved, but in accordance with the springs 17 and 18.

The combination lock device 14 accordingly comprises a main bolt 15 positioned transversely with respect the longitudinal axis of said hollow blade end 11, and the combination dials or rings 21, 22, 23, and 24 are operatively mounted about the main bolt 15. A chrome-plated push button 26 which surrounds the end 20 of the main bolt 15 can be used to actuate the main bolt 15 when the locking mechanism 14 has set the main bolt 15 free.

When inserted in the keyway and after obscuring the combination which will set the main bolt 15 free, the guard device 10 will substantially preclude unauthorized tampering with the lock, and particularly children will not be allowed to play with the ignition system, as will be described in greater detail below.

The hollow blade end 11 has a length which corresponds substantially to the depth of the keyway of the automobile ignition lock. To fit the keyway, the hollow blade end 11 has an exterior keyhole groove 27 in its upper wall 28. The hollow blade end 11 also has a lower wall 29 with a further groove 30.

A spring member 31 is positioned in the cavity 32 formed by the upper wall 28 and the lower wall 29. The spring member 31 is generally V-shaped, with a first upper leg 33 and a second lower leg 34 which is shaped with several bent portions to present a plurality of tooth-shaped formations 35.

With particular reference to FIG. 5, the formations 35 are generally formed with a right-angle leg 35*a*.

Thus, within the hollow blade end 11, there is provided the movable spring member 31, moveable due to its inherent elasticity and adapted to assume with its tooth-shaped formations 35 a first locking position whereby the formations 35 respectively engage the pins (not shown) of the ignition lock (also not shown) to guard the automobile ignition lock, by precluding operation thereof.

Furthermore, the second lower end 34 of the spring member 31 has a length which is sufficient to be engaged by the actuation pin 16 of the main bolt 15. Thus, when the main bolt 15 is free to be moved, the main bolt 15 can be shifted such that the actuation pin 16, in turn, moves the second, lower leg or end 34 of the spring member 31 until the tooth-shaped formations 35 are sufficiently clear of the pins of the ignition lock, and the guard device 10 can be pulled from the keyway.

The operation of the guard device 10 is controlled by the combination-type lock means 14 which allows selective removal of the guard device 10 from the ignition lock keyway that it blocks, but knowledge of the combination to gain access for removal of the guard device 10 from the keyway is required.

With particular reference to FIGS. 7 and 8, the lock formations 15*a*, 15*b*, 15*c* and 15*d* of the main bolt 15, and the dials 21, 22, 23 and 24 are arranged in such a way that the lock formations are respectively positioned between the dials when the lock mechanism 14 is in the normal position. The position of the main bolt 15, the actuation pin 16, and the first leg 33 is then as is shown in FIG. 8.

For removing the guard device 10, the push button 26 is depressed and the main bolt 15 is displaced such that the lock formations 15*a*, 15*b*, 15*c* and 15*d* are respectively aligned with the dials 21, 22, 23 and 24, as is shown in FIG. 7. Correct setting of the dials will then allow removal of the guard device 10.

It will be understood that the embodiment illustrated in the aforesaid is merely used for describing the present invention, but not as limiting the present invention. Any structure or apparatus made with or without minor modifications but not deviating from the spirit, concept and features of the present invention is deemed as being included in the scope of the claims of my invention.

I claim:

1. A keyhole guard device for automobile ignition locks which comprises:
   - a hollow handle portion with which said guard device can be held and selectively inserted and removed from an ignition lock keyway;
   - a combination lock means wherein the locking mechanism includes at least one main bolt, said main bolt being housed in said hollow handle portion;
   - a hollow blade end unitary with said hollow handle portion and its interior in communication with the interior of said hollow handle portion; and
   - a spring element operatively connectable to said main bolt, said spring element being adapted to assume an extended, active, position and a retracted, inactive, position;
   - said main bolt and said spring element being capable of selectively interacting such that the hollow blade end can be inserted into the keyway of the respective automobile ignition lock when said spring element is in its inactive position, but it can only selectively be taken out of the keyway of the respective automobile ignition lock by setting of the unlocking combination to allow actuation of said main bolt and bringing said spring element into its inactive positon.

2. The guard device of claim 1, wherein said combination lock means includes four dials with 10 numbers.

3. The combination lock device of claim 1, comprising:
   - a main bolt positioned transversely with respect the longitudinal axis of said hollow blade;
   - a sleeve partially surrounding said main bolt;
   - a plurality of combination dials mounted at said main bolt; and
   - a push button operatively connected at one end of said main bolt for actuating said main bolt.

4. The guard device of claim 1 with a key chain hole in said handle portion.

5. The ground device of claims 1 wherein said main bolt is a round shaft with an actuation pin at its approximate center, and each end of said main bolt is biased by respective springs.

6. The guard device of claim 3 wherein said spring element is positioned in the cavity formed by the upper wall and the lower wall of said hollow handle portion, said spring element being generally U-shaped, with a first, upper, leg and a second, lower, leg wherein said second leg is shaped with several bent portions to present a plurality of tooth-shaped formations, said spring element being operatively connectable to said main bolt of said combination lock, and said spring element and said combination lock selectively interacting such that the hollow blade end can be freely inserted into the respective automobile ignition lock for substantially blocking the keyway against unauthorized of the ignition lock, and said guard device being capable of being selectively taken out of the keyway of the respective automobile ignition lock when said main bolt is moved to its actuating position upon setting of the unlocking combination to allow actuation of said main bolt.

7. The device of claim 3 wherein said main bolt has lock formations and an actuation pin which project through apertures in said sleeve, and wherein said combination lock means includes dials, with a respective lock formation of said main bolt being adapted to be aligned with a respective dial to bring the locking mechanism to the activation stage in which said device can be removed from a keyhole upon all lock formations and dials having been aligned in accordance with the combination of said locking mechanism.

8. The device of claim 7 which has four dials grouped in pairs of two at each side of said actuation pin.

* * * * *